US005685205A

United States Patent [19]

Suksi

[11] Patent Number: 5,685,205

[45] Date of Patent: Nov. 11, 1997

[54] ADJUSTABLE MULTI-PURPOSE HAND TOOL

[75] Inventor: Paul Suksi, Colorado Springs, Colo.

[73] Assignee: Alvin C. Collins, Colorado Springs, Colo.

[21] Appl. No.: 588,411

[22] Filed: Jan. 18, 1996

[51] Int. Cl.[6] ..... B25B 13/14

[52] U.S. Cl. ..... 81/77; 81/165

[58] Field of Search ..... 81/77, 165–170, 81/155, 129, 129.5

[56] References Cited

U.S. PATENT DOCUMENTS

| | | | |
|---|---|---|---|
| 965,198 | 7/1910 | Kinsel et al. | 81/165 |
| 975,609 | 11/1910 | Ferguson | 81/77 |
| 4,967,613 | 11/1990 | Cone | 81/166 |
| 4,987,805 | 1/1991 | Ejdenwik | 81/77 |

FOREIGN PATENT DOCUMENTS 166763 7/1921 United Kingdom .

OTHER PUBLICATIONS

Collins Industries International, Inc., "All you need is Li'l Swede", On Sale Brochure, 1 year prior to Jan. 18, 1996.

*Primary Examiner*—D. S. Meislin

*Attorney, Agent, or Firm*—Pollock, Vande Sande & Priddy

[57] ABSTRACT

A multi-purpose adjustable hand tool. The hand tool includes at one end thereof a closed box end having an adjustable opening for accommodating different size components. The other end of the multi-purpose hand tool is configured to accept a plurality of different linearly adjustable grasping members, which are adjusted at the same time the box end effective opening is adjusted. A pliers handle and grasping portion may be pivotally connected to the end of the slide for providing an adjustable pliers. Means are provided on the hand tool for linearly positioning the slide within a channel of the handle, thereby effectively changing the size of the tool grasping members.

10 Claims, 2 Drawing Sheets

ADJUSTABLE MULTI-PURPOSE HAND TOOL

The present invention relates to hand tools. Specifically, a versatile, adjustable hand tool is disclosed having replaceable grasping members.

Mechanics and other artisans who use hand tools typically have a large set of various tool sizes for grasping the heads of bolts, nuts and other threaded components. A full set of wrenches, having a single wrench devoted to a single component size, may include up to 40 individual members.

Adjustable tools, such as adjustable wrenches of various descriptions and kinds, are also known in the art for permitting a single tool to be adjusted to various size fasteners and other threaded components. One such adjustable tool includes the "Lil Swede" wrench which has been the subject of a Swedish design patent. The aforesaid wrench includes an elongated handle having at one end a multifaced polygon opening, simulating a box wrench. Along the elongated handle of the wrench is a channel supporting an adjustable slide. The adjustable slide includes at one end a notch which is capable of reducing the effective size of the polygon opening, thereby creating an adjustable box wrench.

The foregoing device, although having many useful applications, includes a number of drawbacks. The first is that the slide member is permanently retained within the channel and cannot be readily removed. Numerous tightening and loosening operations require a different type of tool than a box end. Thus, it would be advantageous to provide an adjustable tool which provides not only a box end type connection to a fastener, but also an open end grasping member.

SUMMARY OF THE INVENTION

It is an object of this invention to provide a multi-purpose hand tool having an adjustable size.

It is a more specific object of this invention to provide a hand tool which can accommodate various tightening and loosening operations.

It is an even more specific object of this invention to provide an adjustable hand tool having an adjustable box end grasping member as well as an adjustable open end grasping member.

These and other objects are provided by an apparatus in accordance with the present invention. An elongated handle is provided, having at one end thereof a box end with an opening including a multi-faceted polygon surface. A slide member is received within a channel which extends along the length of the elongated handle and into the box end opening. An adjustment mechanism is provided for advantageously positioning the slide within the channel so that the slide can control the effective size of the box end opening.

The remaining end of the slide member includes a tool member which may engage a complementary tool portion fixed to the elongated handle, to provide an open ended grasping member for use in tightening and loosening operations for which the opposite closed box end of the wrench are not suitable.

The channel of the elongated handle is laterally open to one side of the handle and is advantageously configured to permit lateral removal of the slide member from the channel. Thus, different slide members having different configurations of a grasping member, may be readily inserted in the channel for use.

DESCRIPTION OF THE PREFERRED EMBODIMENT

Figure 1:
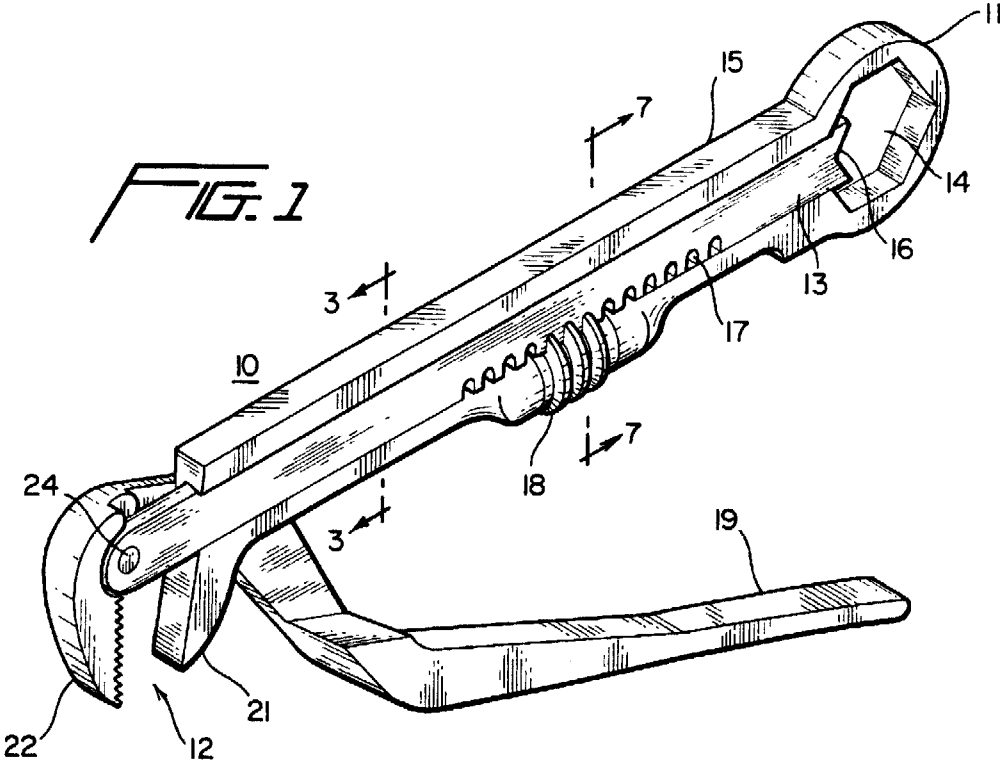
FIG. 1 is a perspective view of a multi-purpose hand tool in accordance with a preferred embodiment of the invention.

Referring now to FIG. 1, there is shown a perspective view of a multi-purpose tool 10 in accordance with a preferred embodiment. The multi-purpose tool 10 includes an elongated handle 15 having a box type wrench end 11 at one end. The elongated handle 15 includes therein a channel 25 which is open at one side of the handle. The elongated channel 25 retains a slide 13 which is position-adjustable within the channel 25. One end of the slide 13 extends into the opening 14 of the box end, and includes a notch 16 which effectively adjusts the opening 14 size as the slide 13 is positioned within channel 25. The notch 16 preferably defines a pair of facets **16*a* and 16*b* which have an angle with each other equal to the angle defined by the facets 11*a*, 11*b* of the box end 11. The notch end 16** is positioned to provide different box end sizes for removing fasteners having a polygon head configuration.

The opposite end of the slide member 13 includes in the embodiment of FIG. 1, a grasping member 22 connected by a pivot point 24. The grasping member 22 cooperates with an angularly disposed grasping member 21 connected to the end of elongated handle 15. The grasping member 22 is connected to a handle 19 which is disposed at an angle to the grasping member 22, and which is used to pivot the grasping member towards and away from grasping member 21.

The grasping member 22 and handle 19 form, with respect to the grasping member 21, a pliers-type tool 12 having an open end configuration for grasping fasteners and/or threaded objects which cannot be grasped with the box end 11. The grasping member 22 and grasping member 21 include along their cooperating faces serrations for improving the grip of the tool. Serrations or knurling of a different grade may be included along the handle portion 19 to facilitates using the tool.

Figure 5:
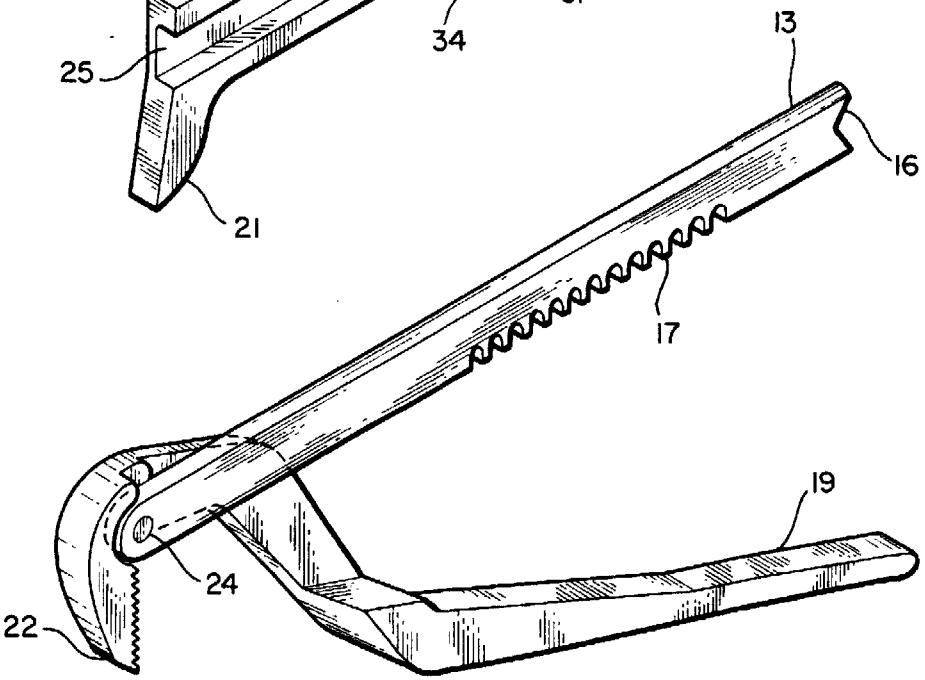
FIG. 5 illustrates one type of grasping member for use in the multi-purpose tool.

FIG. 5 is a detailed view of the slide arrangement 13 which has attached at one end thereof the pliers handle 19 and grasping portion 22. The handle 19 is configured at an angle to the grasping portion 22, and pivotally connected by a pin 24 to the slide 13. The handle 19 is angularly disposed to be substantially parallel to the handle 15 when in the closed position.

The effective size of both the box end 11 and the pliers tool 12 may be adjusted using the worm gear 18. The worm gear 18 is mounted to rotate and engage various teeth 17 along the mid-portion of slide 13. The worm gear 18 and teeth 17 form an adjusting means for changing the relative position of the slide 13 within the channel 25. The single adjustment means can therefore control the effective size of the opening 14 of the box end 11, as well as the size of the open end between grasping members 21 and 22.

Figure 4:
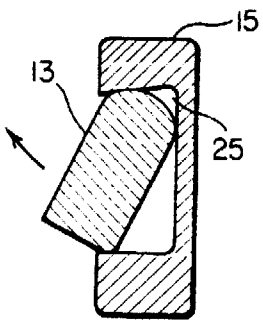
FIG. 4 is a second section view of the multi-purpose tool of FIG. 1.
Figure 3:
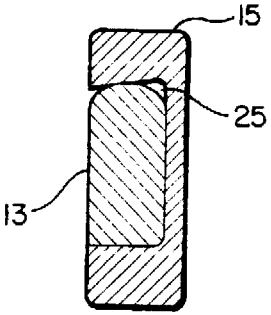
FIG. 3 is a section view of the tool handle of FIG. 1.

FIGS. 3 and 4 illustrate the configuration of the channel 25 which is open along one side of handle 15, permitting slide 13, attached grasping member 22 and handle 19 to be removed from the handle 15. Because of the configuration of the channel 25, i.e., the dimension of the channel increases in the direction away from the open side towards the closed side, it is possible by rotating the slide 13, as shown in FIG. 4, to laterally remove or insert a new slide having a new type of tool grasping member at one end thereof.

Figure 8:
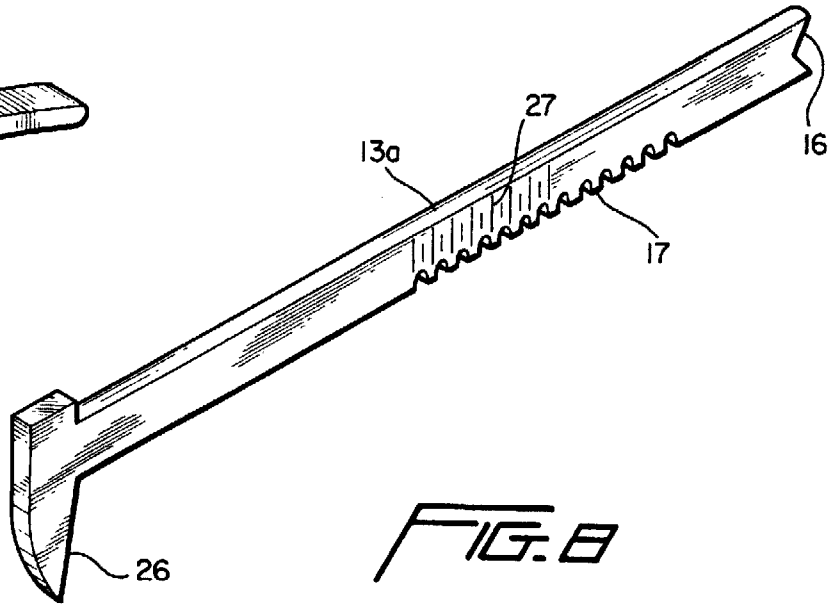
FIG. 8 illustrates a second grasping member configuration on one end of the slide for use in the multi-purpose tool.

FIG. 8 illustrates a variation of the tool grasping member 26 which may be inserted in the handle 15. The slide 13 includes at an end thereof a flat grasping member 26 which may be inserted in place of the handle 19 and grasping portion 22 of FIG. 5, providing an adjustable wrench at one end and a closed box end 11. The slide 13 includes a series of gradations 27 which may be used to position the slide to an accurate location defining a tool size.

Figure 2:
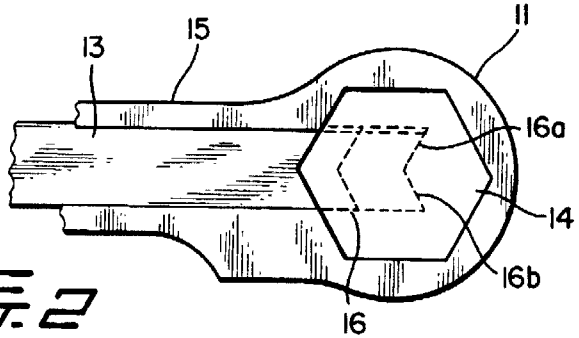
FIG. 2 is a plan view of the box end of the multi-purpose tool of FIG. 1.

The adjustment of the effective size of the box end opening 14 is illustrated more completely in FIG. 2, illustrating that the notch 16 may be continuously positioned to various positions to change the size of the box opening.

Figure 7:
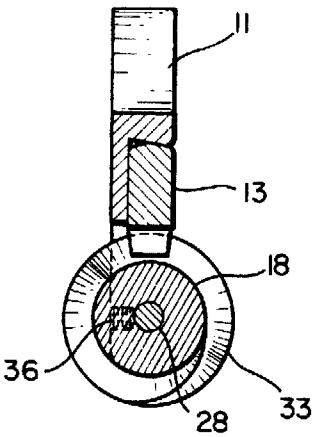
FIG. 7 is a section view showing the means for adjusting the position of the slide within the elongated handle.
Figure 6:
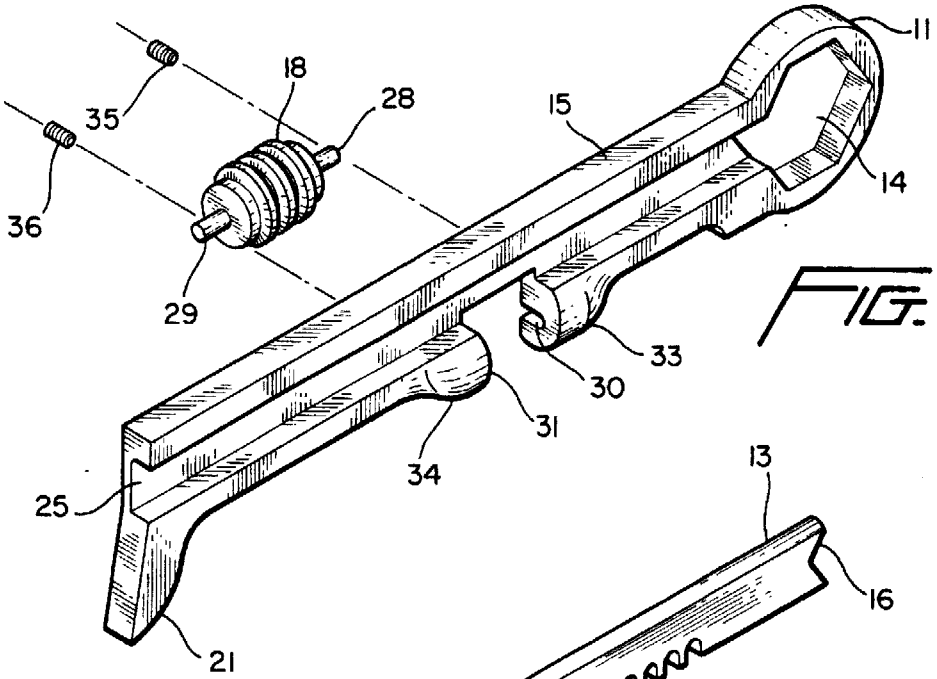
FIG. 6 illustrates an exploded view of the handle of the multi-purpose tool.

Details of the adjusting mechanism for continuously positioning slide 13 may be seen in accordance with FIG. 6. FIG. 6 is an exploded view of the handle, showing the mounting of a worm gear 18 to the handle 15. The worm gear 18 has axles 28 and 29, which are supported within recesses 30 and 31 on the handle. The handle is enlarged at portions 33 and 34 to accommodate axles 28 and 29 at a position where the gear teeth of worm gear 18 engage the teeth 17 on the slide member. FIG. 7 is a section view of the worm gear adjustment mechanism illustrating the set screws 35 and 36 which retain the axles 28 and 29 within the recess Thus, there is described with respect to several embodiments of the invention, an adjustable hand tool which may engage different types of threaded articles. Those skilled in the art will recognize yet other embodiments described more particularly by the claims which follow.

What is claimed is:

1. A multi-purpose tool comprising:

an elongated handle having at one end thereof an angularly extending first tool portion, said handle including a channel open to one side of the handle, said channel having a width which increases in the direction from said one side towards an opposite closed side, to laterally receive a tool bearing slide;

a worm gear rotatably fastened to an edge of said elongated handle, having teeth which extend into said channel; and an elongated slide removably supported in said channel, one edge of said slide being curved and facing an edge of said channel, said slide having a plurality of teeth along one edge thereof which engage said worm gear teeth as said slide is laterally inserted into said channel, said elongated slide having at one end thereof a second tool portion which forms with said first tool portion a grasping member.

2. A multi-purpose tool according to claim 1, wherein said second tool portion is pivotally connected to said elongated slide, and which includes a second handle portion which pivots said second tool portion towards and away from said first tool portion.

3. A multi-purpose tool according to claim 1, wherein said first and second tool portions have surfaces which include serrations for grasping an object therebetween.

4. A multi-purpose tool according to claim 1, wherein said elongated handle includes at an opposite end thereof a third tool portion which cooperates with a fourth tool portion on said elongated slide to form a second grasping member.

5. The multi-purpose tool according to claim 4, wherein said third and fourth tool portion comprise an adjustable box wrench.

6. The multi-purpose tool of claim 1, wherein said elongated slide includes a series of graduations for measuring the displacement of said elongated slide with respect to said elongated handle.

7. The multi-purpose tool of claim 1, wherein said teeth on said elongated slide are confined to a mid-portion of said slide.

8. A multi-purpose tool comprising:

a slide member having on one end thereof a pivoted grasping member connected to a handle and extending at an angle thereto, said slide member having one edge curved, and an opposite edge generally flat;

an elongated handle portion having a channel therein, open at one side of said elongated handle portion to receive said slide member, said channel having a width which increases in the direction towards a closed side opposite said open side, whereby said slide may be inserted laterally into said channel, said elongated handle portion having at one end a polygon opening with multiple flats into which said slide extends, and at an opposite end thereof a tool portion for cooperating with said grasping member to provide for an open grasping tool; and means fixed to said elongated handle portion for moving said slide member along said channel, thereby effectively changing the grasping size of said open grasping tool and said polygon effective opening size.

9. The multi-purpose tool of claim 8, wherein said slide member includes at an opposite end thereof a means for effectively reducing the effective size of said polygon opening.

10. The multi-purpose tool of claim 8, wherein said slide includes at an end thereof a notch for effectively reducing the size of said polygon opening.

* * * * *